US012624846B2

(12) United States Patent
Merlino et al.

(10) Patent No.: US 12,624,846 B2
(45) Date of Patent: May 12, 2026

(54) FAN ASSEMBLY FOR AN AIR CONDITIONER APPLIANCE

(71) Applicant: Haier US Appliance Solutions, Inc., Wilmington, DE (US)

(72) Inventors: Kenton Merlino, Louisville, KY (US); Richard Michael Phillips, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 109 days.

(21) Appl. No.: 18/615,651

(22) Filed: Mar. 25, 2024

(65) Prior Publication Data

US 2025/0297747 A1 Sep. 25, 2025

(51) Int. Cl.

| | |
|---|---|
| ***F24F 13/20*** | (2006.01) |
| ***F24F 1/027*** | (2019.01) |
| ***F24F 1/0284*** | (2019.01) |
| ***F24F 13/22*** | (2006.01) |
| ***F24F 13/28*** | (2006.01) |

(52) U.S. Cl.

CPC ..... *F24F 1/027* (2013.01); *F24F 1/0284* (2019.02); *F24F 13/20* (2013.01); *F24F 13/222* (2013.01); *F24F 13/28* (2013.01); *F24F 2013/205* (2013.01); *F24F 2013/225* (2013.01)

(58) Field of Classification Search

CPC ..... F24F 1/027; F24F 1/0284; F24F 13/20; F24F 13/222; F24F 13/28; F24F 2013/205; F24F 2013/225; B01D 46/10

See application file for complete search history.

(56) References Cited

U.S. PATENT DOCUMENTS

| | | | | |
|---|---|---|---|---|
| 7,162,889 | B2 | 1/2007 | Lee et al. | |
| 10,072,871 | B1 * | 9/2018 | Shaffer | F24F 13/224 |
| 11,226,117 | B2 | 1/2022 | Sakal | |
| 11,313,571 | B2 | 4/2022 | Patel et al. | |
| 2019/0054407 | A1 * | 2/2019 | Bailey | F26B 25/007 |
| 2019/0154278 | A1 * | 5/2019 | Jewell | F24F 1/027 |
| 2019/0154299 | A1 | 5/2019 | Jewell et al. | |
| 2021/0018187 | A1 * | 1/2021 | Sakal | F24F 1/035 |
| 2023/0228447 | A1 | 7/2023 | Longenecker et al. | |

FOREIGN PATENT DOCUMENTS

| | | | |
|---|---|---|---|
| CN | 214038693 | U | 8/2021 |
| CN | 215637621 | U | 1/2022 |
| JP | H0680018 | A * | 3/1994 |
| JP | 6014856 | B2 | 10/2016 |

* cited by examiner

*Primary Examiner* — Frantz F Jules
*Assistant Examiner* — Martha Tadesse
(74) *Attorney, Agent, or Firm* — Dority & Manning, P.A.

(57) ABSTRACT

An air conditioner unit may include a bulkhead, a vent aperture, and a fan assembly. The bulkhead may define an indoor portion and an outdoor portion. The vent aperture may be defined in the bulkhead. The fan assembly may urge a flow of make-up air from the outdoor portion through the vent aperture to the indoor portion. The fan assembly may include a fan housing and an auxiliary fan. The makeup air duct may be in fluid communication with the vent aperture. The fan housing may include a bottom wall defining a vertical weep hole to permit water to exhaust from the makeup air duct apart from the vent aperture. The auxiliary fan may be positioned within the fan housing.

19 Claims, 11 Drawing Sheets

FAN ASSEMBLY FOR AN AIR CONDITIONER APPLIANCE

FIELD OF THE DISCLOSURE

The present disclosure relates generally to air conditioner units, and more particularly to fan assemblies for providing make up air in packaged terminal air conditioner units.

BACKGROUND OF THE DISCLOSURE

Air conditioner or conditioning units are conventionally utilized to adjust the temperature indoors (e.g., within structures such as dwellings and office buildings). Such units commonly include a closed refrigeration loop to heat or cool the indoor air. Typically, the indoor air is recirculated while being heated or cooled. A variety of sizes and configurations are available for such air conditioner units. For example, some units may have one portion installed indoors that is connected to another portion located outdoors (e.g., by tubing or conduit carrying refrigerant). These types of units are typically used for conditioning the air in larger spaces.

Another type of air conditioner unit, commonly referred to as single-package vertical units (SPVU) or package terminal air conditioners (PTAC), may be utilized to adjust the temperature in somewhat smaller indoor spaces, for example, a single room or group of rooms of a structure. These units typically operate like split heat pump systems, except that the indoor and outdoor portions are defined by a bulkhead and all system components are housed within a single package that installed in a wall sleeve positioned within an opening of an exterior wall of a building.

PTACs often need to draw air from the outdoor portion into the indoor portion. Accordingly, certain PTACs allow for the introduction of make-up air into the indoor space (e.g., through a vent aperture defined in the bulkhead that separates the indoor and outdoor side of the unit). The vent aperture is usually equipped with an auxiliary fan or make-up air module to urge a flow of make-up air from the outdoor side of the PTAC into the conditioned room. Notably, it may be desirable to filter the outdoor air before introducing it into the indoor space. However, the make-up air subsystem is often limited by size constraints, cost constraints, labor constraints, and maintenance/serviceability constraints. Due to these constraints, conventional air filters used in such assemblies may be ineffective in properly filtering the make-up air, particularly at higher flow rates required to meet industry required standards for make-up air flow rate.

Separate from or in addition to air flow or filtration considerations for the make-up air, moisture within the make-up air may lead to various issues. For instance, outdoor air may include relatively high amounts of water vapor or moisture (e.g., depending on the ambient environment). In turn, such water vapor may collect and condense within certain portions of the fan assembly or vent aperture. If permitted to accumulate, the condensed water may lead to mildew or mold growth, or may otherwise interfere with proper functioning of various (e.g., electronic) components.

Accordingly, improved air conditioner units and systems for filtering make-up air would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, an air conditioner unit is provided. The air conditioner unit may include a bulkhead, a vent aperture, and a fan assembly. The bulkhead may define an indoor portion and an outdoor portion. The vent aperture may be defined in the bulkhead. The fan assembly may urge a flow of make-up air from the outdoor portion through the vent aperture to the indoor portion. The fan assembly may include a fan housing and an auxiliary fan. The makeup air duct may be in fluid communication with the vent aperture. The fan housing may include a bottom wall defining a vertical weep hole to permit water to exhaust from the makeup air duct apart from the vent aperture. The auxiliary fan may be positioned within the fan housing.

In another exemplary aspect of the present disclosure, a fan assembly is provided. The fan assembly may include a fan housing, an auxiliary fan, and an air filter. The fan housing may define a fan slot, a filter slot, and a makeup air duct. The fan housing may include a bottom wall defining a vertical weep hole to permit water to exhaust from the makeup air duct. The auxiliary fan may be positioned within the fan slot of the fan housing. The air filter may be positioned within the filter slot above the vertical weep hole.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

according to exemplary embodiments of the present disclosure.

Figure 10:
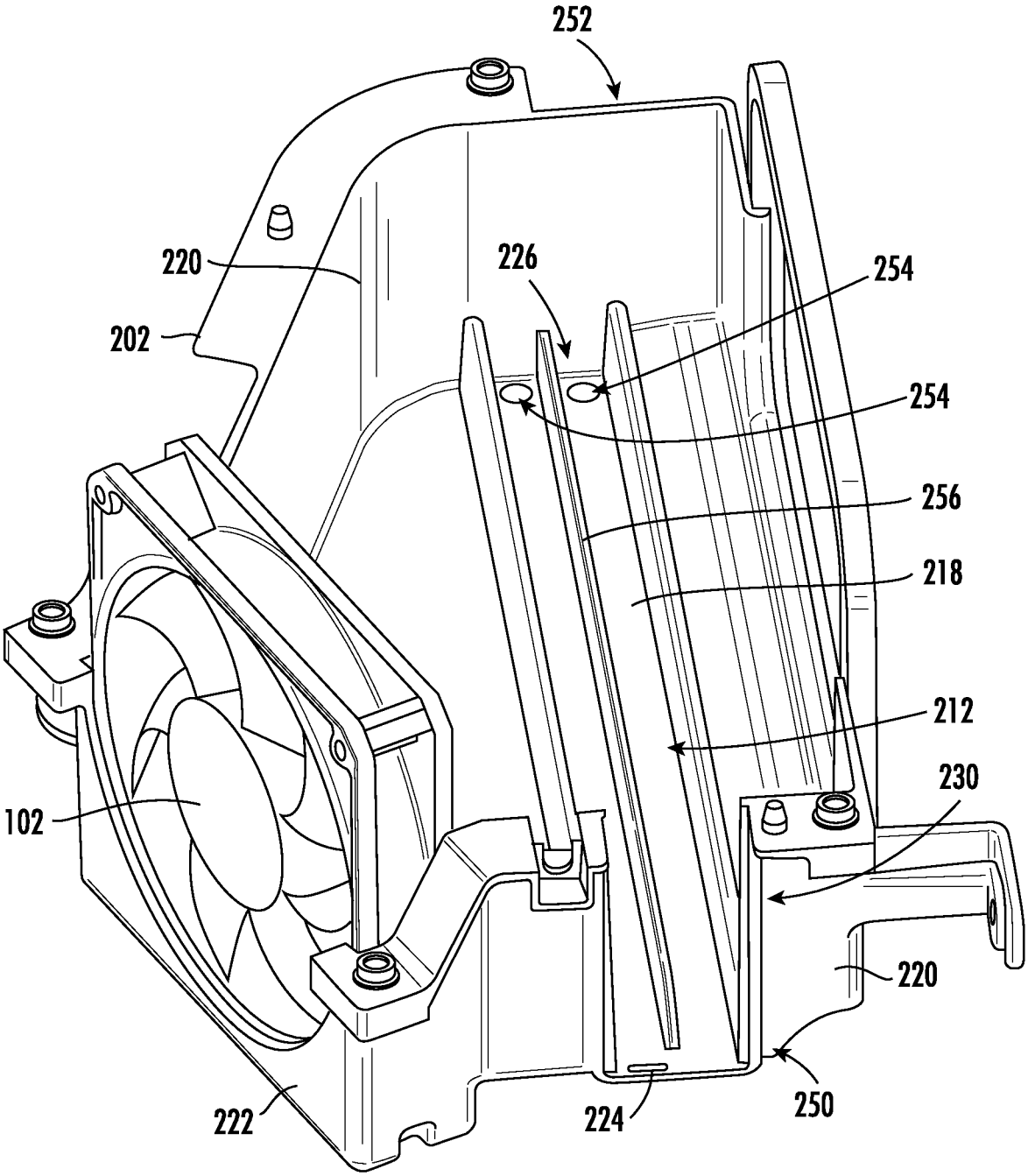

FIG. 10 provides a perspective view of a portion of a fan assembly according to other exemplary embodiments of the present disclosure.

Figure 11:
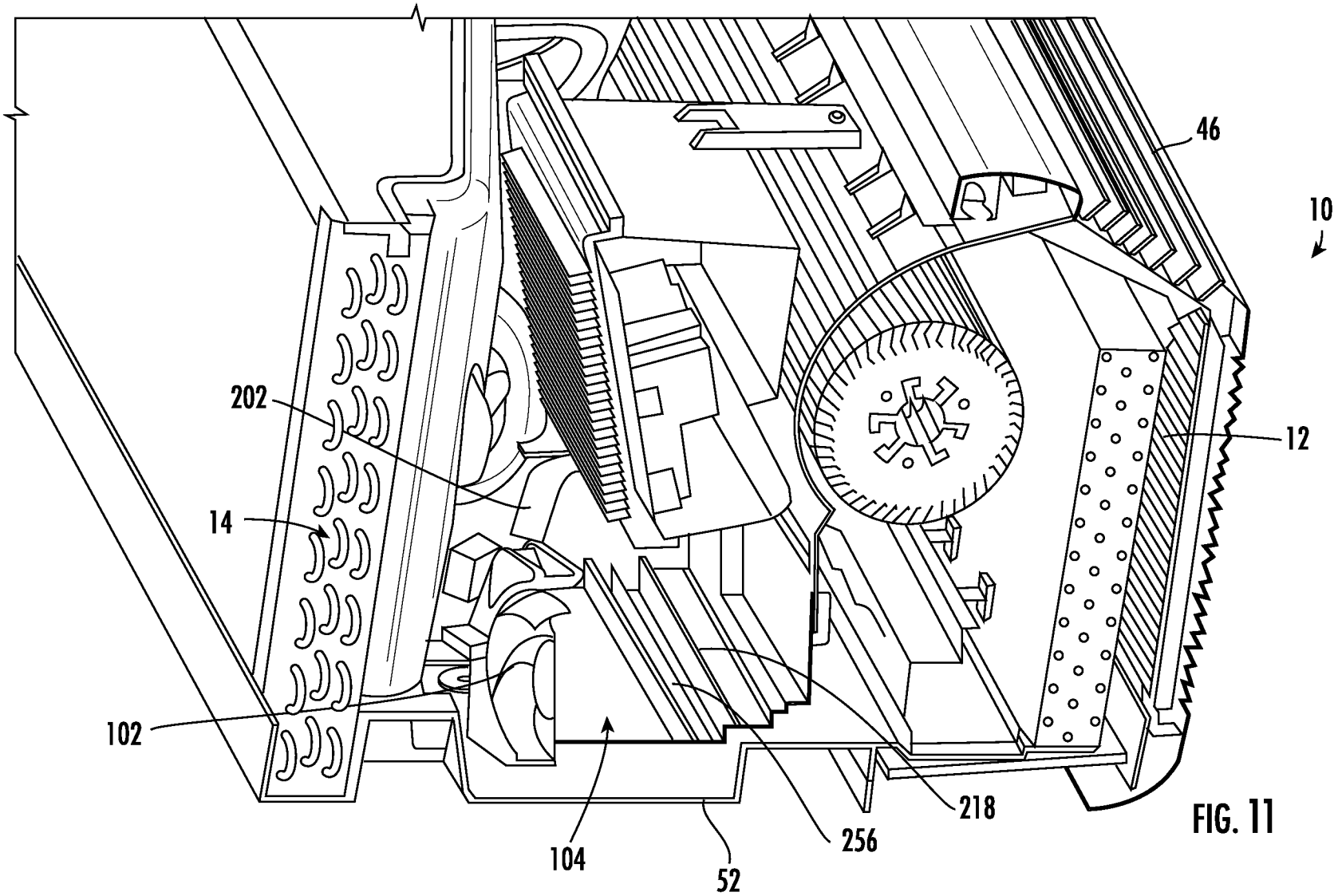

FIG. 11 provides a rear, cross-sectional, perspective view of an air conditioner unit and bulkhead, including a fan assembly for providing make-up air in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Advantageously, various aspects of the present disclosure may prevent moisture accumulation within a fan assembly (e.g., of an air conditioner unit). Additionally or alternatively, aspects of the present disclosure may provide a packaged terminal air conditioner unit that includes a filter assembly capable of filtering large flow rates of air while minimizing parts, assembly costs, and maintenance costs.

Figure 1:
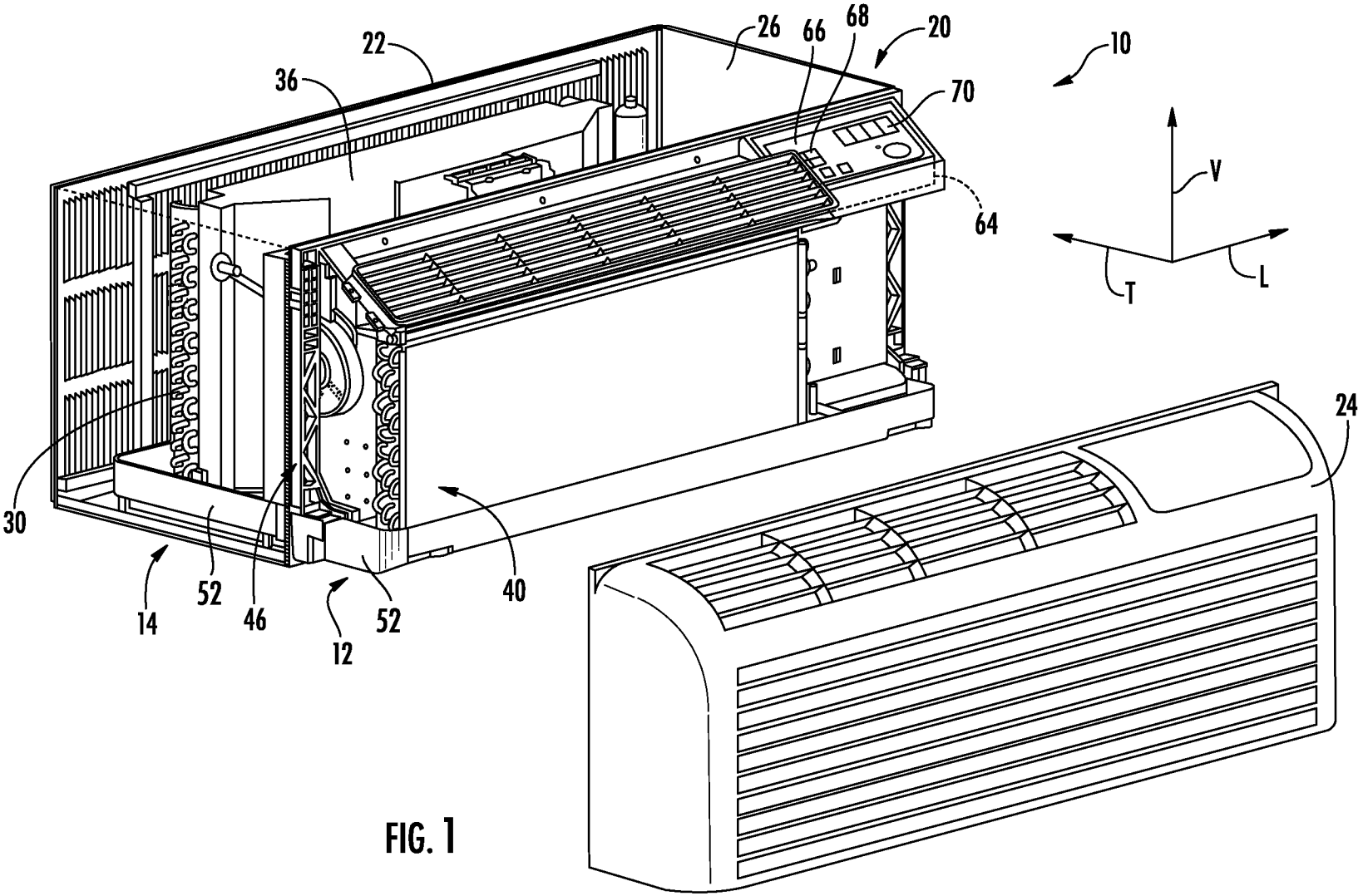
FIG. 1 provides a perspective view of an air conditioner unit, with part of an indoor portion exploded from a remainder of the air conditioner unit for illustrative purposes, in accordance with one exemplary embodiment of the present disclosure.
Figure 2:
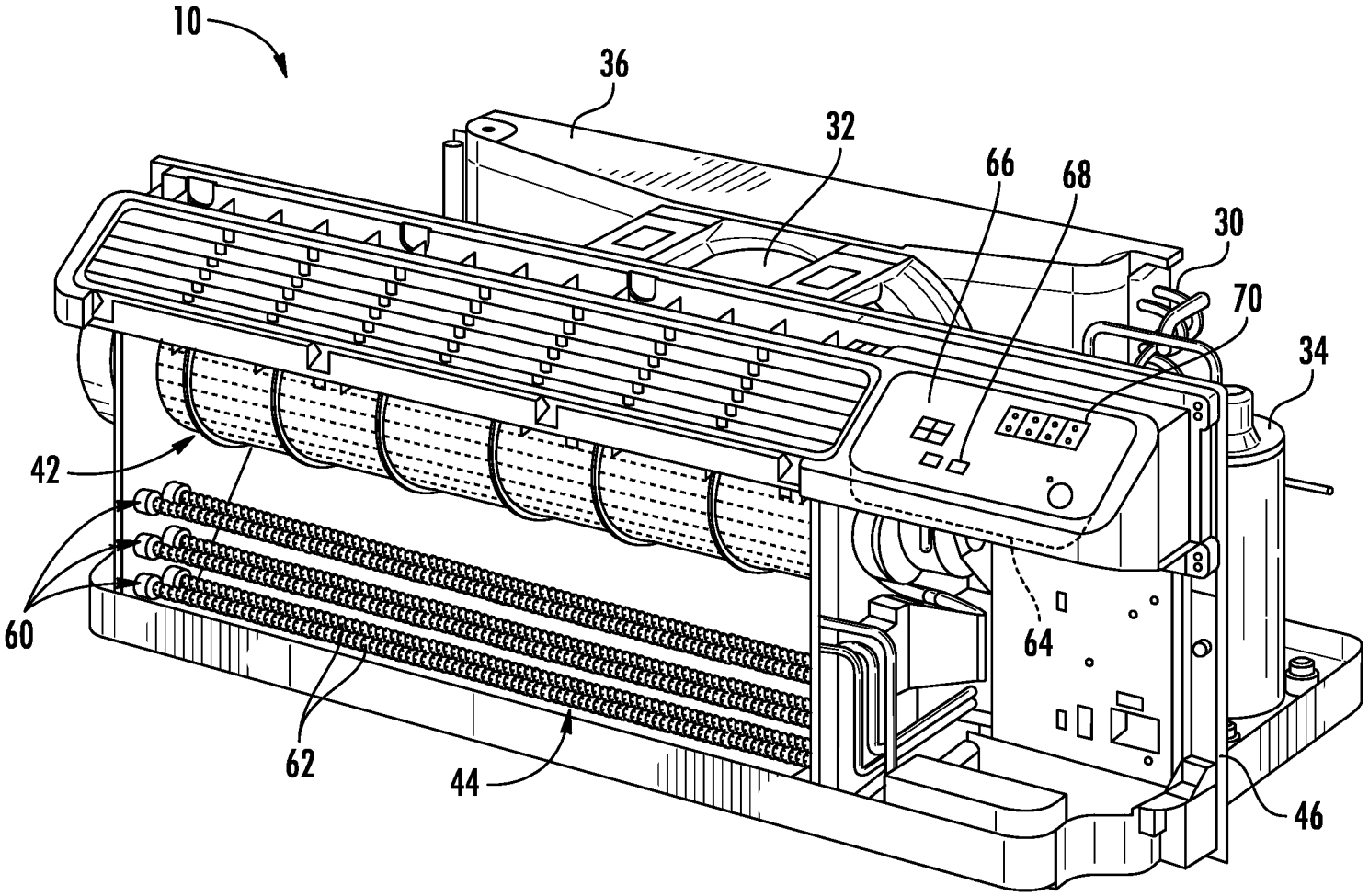
FIG. 2 provides another perspective view of components of the indoor portion of the exemplary air conditioner unit of FIG. 1.

Referring now to FIGS. 1 and 2, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined. Although aspects of the present subject matter are described with reference to PTAC unit 10, it should be appreciated that aspects of the present subject matter may be equally applicable to other air conditioner unit types and configurations, such as single package vertical units (SPVUs) and split heat pump systems.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32, and a compressor 34 may be housed within the wall sleeve 26. A fan shroud 36 may additionally enclose outdoor fan 32, as shown.

Indoor portion 12 may include, for example, an indoor heat exchanger 40, a blower fan or indoor fan 42, and a heating unit 44. These components may, for example, be housed behind the room front 24. Additionally, a bulkhead 46 may generally support or house various other components or portions thereof of the indoor portion 12, such as indoor fan 42 and the heating unit 44. Bulkhead 46, along with one or more components of the unit 10, may be supported on a base pan 52. Moreover, bulkhead 46 may generally separate and define the indoor portion 12 and outdoor portion 14.

Figure 3:
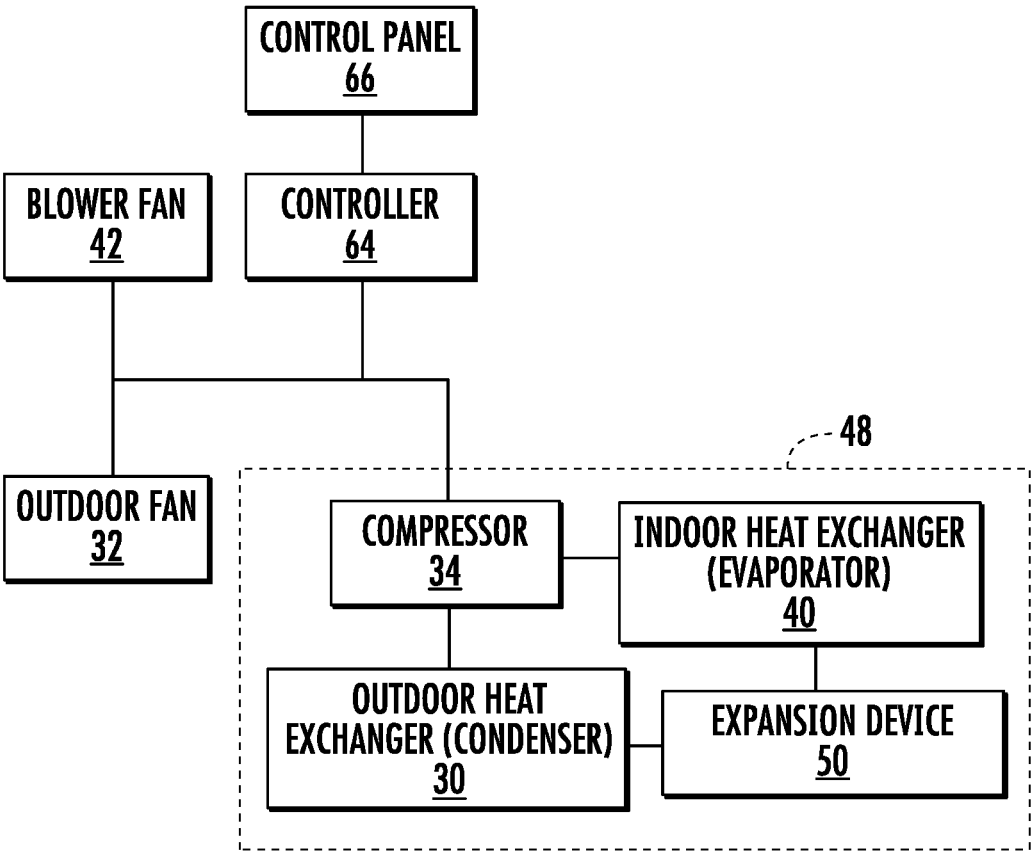
FIG. 3 provides a schematic view of a refrigeration loop in accordance with exemplary embodiments of the present disclosure.

Outdoor and indoor heat exchangers 30, 40 may be components of a sealed system or refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such examples and rather that any suitable refrigerant may be utilized.

As is understood in the art, refrigeration loop 48 may be alternately operated as a refrigeration assembly (and thus perform a refrigeration cycle) or a heat pump (and thus perform a heat pump cycle). As shown in FIG. 3, when refrigeration loop 48 is operating in a cooling mode and thus performing a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed [e.g., 1500 revolutions per minute (RPM)] to a maximum rated speed (e.g., 3500 RPM). Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

Specifically, according to an exemplary embodiment, compressor 34 may be an inverter compressor. In this regard, compressor 34 may include a power inverter, power electronic devices, rectifiers, or other control electronics suitable for converting an alternating current (AC) power input into a direct current (DC) power supply for the compressor. The inverter electronics may regulate the DC power output to any suitable DC voltage that corresponds to a specific operating speed of compressor. In this manner compressor 34 may be regulated to any suitable operating speed (e.g., from 0% to 100% of the full rated power or speed of the compressor). This may facilitate precise compressor operation at the desired operating power and speed, thus meeting system needs while maximizing efficiency and minimizing unnecessary system cycling, energy usage, and noise.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve ("EEV") that enables controlled expansion of refrigerant, as is known in the art. According to alternative embodiments, expansion device 50 may be a capillary tube or another suitable expansion device configured for use in a thermodynamic cycle.

More specifically, according to exemplary embodiments, electronic expansion device 50 may be configured to precisely control the expansion of refrigerant to maintain, for example, a desired temperature differential of the refrigerant across the evaporator (i.e., the outdoor heat exchanger 30 in heat pump mode). In other words, electronic expansion device 50 throttles the flow of refrigerant based on the reaction of the temperature differential across the evaporator or the amount of superheat temperature differential, thereby ensuring that the refrigerant is in the gaseous state entering compressor 34.

In general, the terms "superheat," "operating superheat," or the like are generally intended to refer to the temperature increase of the refrigerant past the fully saturated vapor temperature in the evaporator. In this regard, for example, the superheat may be quantified in degrees Fahrenheit (e.g., such that 1° F. superheat means that the refrigerant exiting the evaporator is 1° F. higher than the saturated vapor temperature). It should be appreciated that the operating superheat may be measured and monitored by controller 64 in any suitable manner. For example, controller 64 may be operably coupled to a pressure sensor for measuring the refrigerant pressure exiting the evaporator, may convert that pressure to the saturated vapor temperature, and may subtract that temperature from the measured refrigerant temperature at the evaporator outlet to determine superheat.

According to exemplary embodiments, expansion device or electronic expansion valve 50 may be driven by a stepper motor or other drive mechanism to any desirable position between a fully closed position (e.g., when no refrigerant passes through EEV 50) to a fully open position (e.g., when there is little or no restriction through the EEV 50). For example, controller 64 may be operably coupled to EEV 50 and may regulate the position of the EEV 50 through a control signal to achieve a target superheat, a target restriction/expansion, etc.

More specifically, the control signal communicated from controller 64 may specify the number of control steps (or simply "steps") and a corresponding direction (e.g., counterclockwise toward the closed position or clockwise toward the open position). Each EEV 50 may have a physical stroke span equal to the difference between the fully open position and the fully closed position. In addition, the EEV 50 may include a step range or range of control steps that correspond to the number adjustment steps it takes for the EEV 50 to travel from the fully closed position to the fully open position.

Each "step" may refer to a predetermined rotation of the drive mechanism (e.g., such as a stepper motor, which may in turn move the EEV 50 a fixed linear distance toward the open or closed position—depending on the commanded step direction). For example, according to the exemplary embodiment, the EEV 50 may have a step range of 500 steps, with 0 steps corresponding to fully closed and 500 steps corresponding to fully open. However, it should be appreciated that according to alternative embodiments, any given electronic expansion valve may include a different number of control steps, and the absolute step adjustments described herein may be varied accordingly.

In addition, as used herein, the position of EEV 50 may be expressed as a percentage (e.g., where 0% corresponds to a fully closed position and 100% corresponds to a fully open position). According to exemplary embodiments, this percentage representation may also refer to the percentage of total control steps taken from the closed position [e.g., with 10% referring to 50 steps (e.g., 10% of the 500 total steps), 80% referring to 400 steps (e.g., 80% of 500 total steps), etc.].

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans (e.g., similar to variable speed compressor 34). For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed (e.g., to reduce noise when full speed operation is not needed). In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66 and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
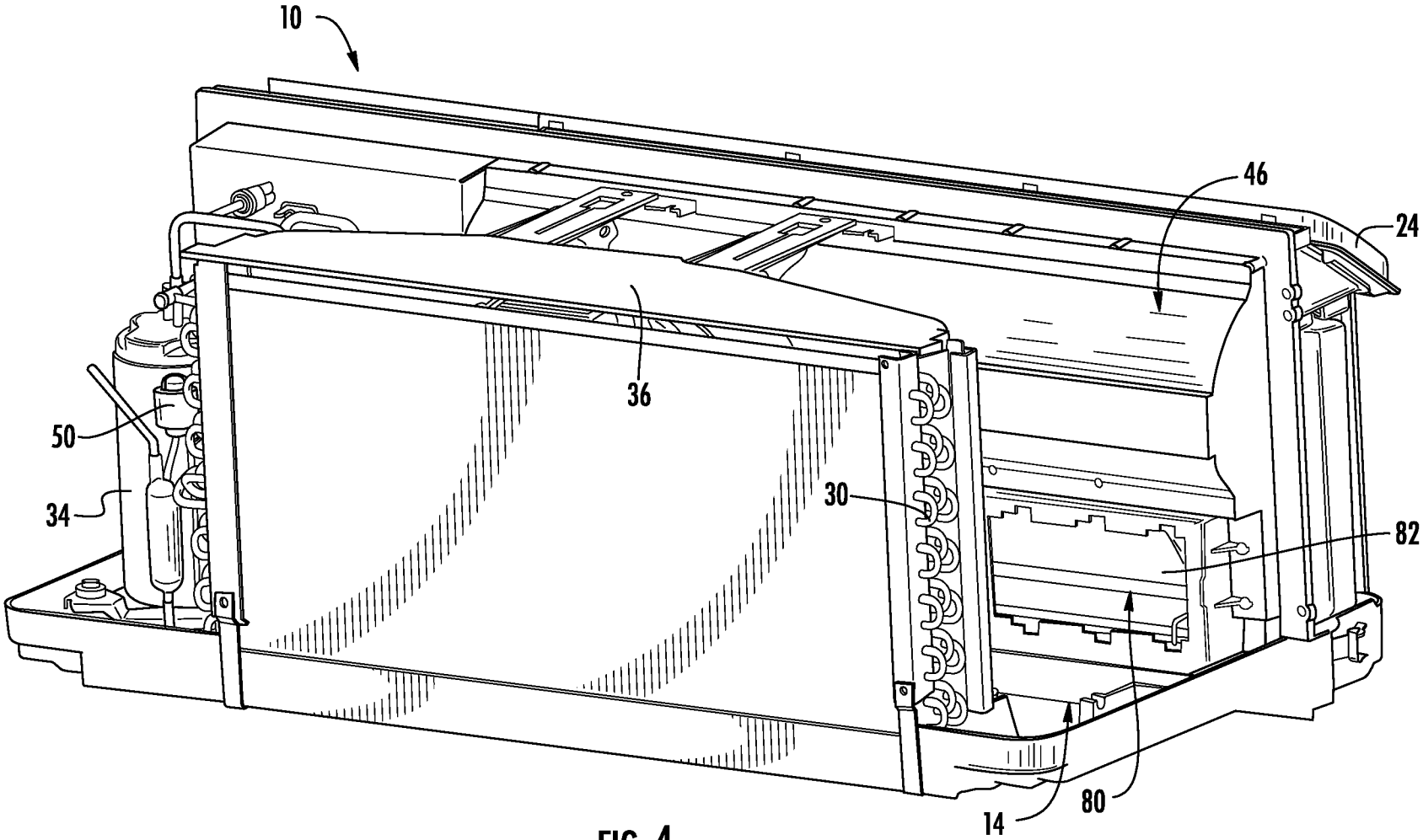
FIG. 4 provides a rear perspective view of an outdoor portion of the exemplary air conditioner unit of FIG. 1, illustrating a vent aperture in a bulkhead in accordance with exemplary embodiments of the present disclosure.

Referring briefly to FIG. 4, a vent aperture 80 may be defined in bulkhead 46 for providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order (e.g., to meet government regulations, to compensate for negative pressure created within the room, etc.). In this manner, according to an exemplary embodiment, make-up air may be provided into the room through vent aperture 80 when desired.

Figure 5:
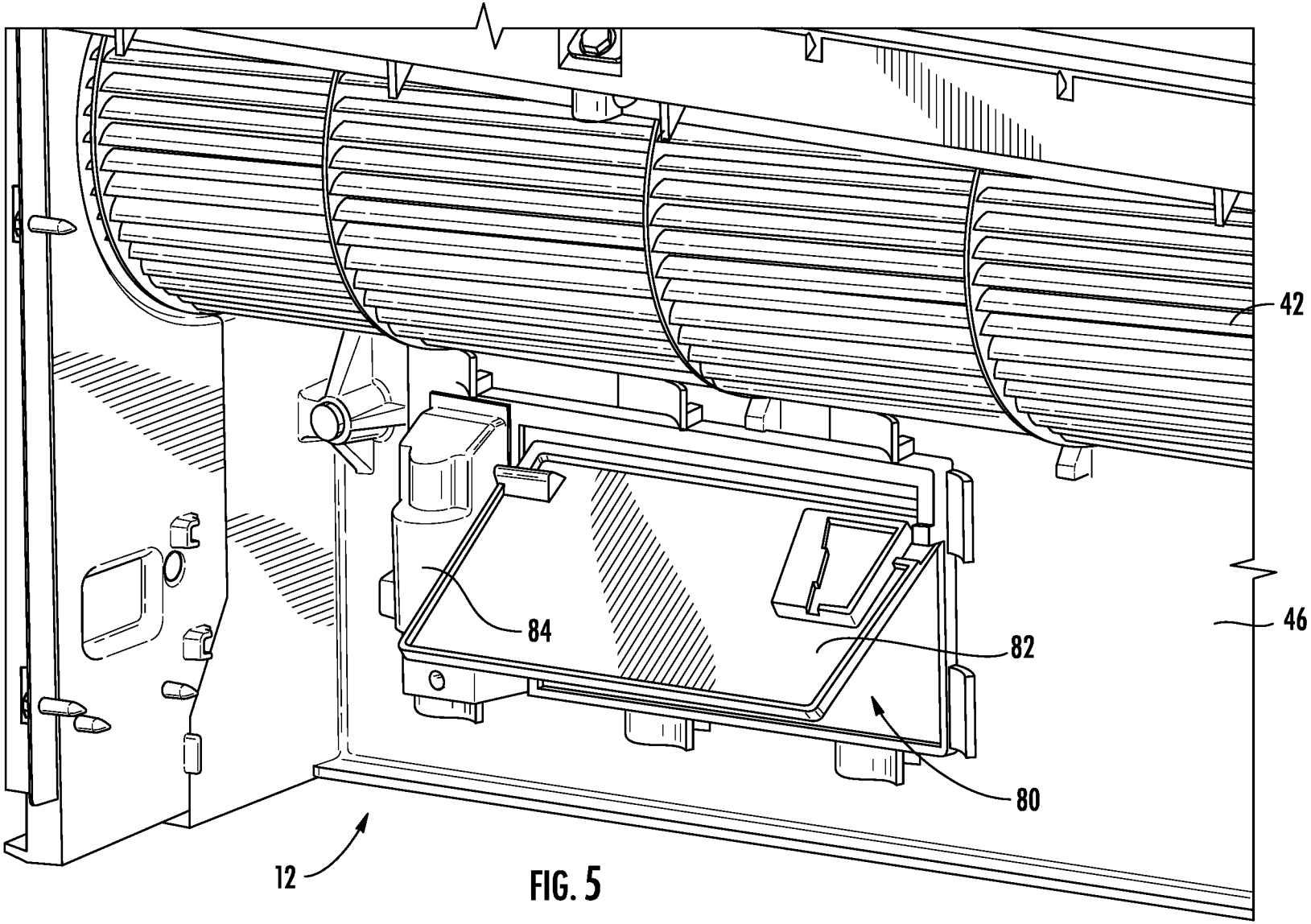
FIG. 5 provides a front perspective view of the exemplary bulkhead of FIG. 4 with a vent door illustrated in the open position in accordance with exemplary embodiments of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, according to an exemplary embodiment of the present subject matter, unit 10 may further include an auxiliary sealed system that is positioned over vent aperture 80 for conditioning make-up air. The auxiliary sealed system may be a miniature sealed system that acts similar to refrigeration loop 48, but conditions only the air flowing through vent aperture 80. According to alternative embodiments, such as that described herein, make-up air may be urged through vent aperture 80 without the assistance of an auxiliary sealed system. Instead, make-up air is urged through vent aperture 80 may be conditioned at least in part by refrigeration loop 48 (e.g., by passing through indoor heat exchanger 40). Additionally, the make-up air may be conditioned immediately upon entrance through vent aperture 80 or sequentially after combining with the air stream induced through indoor heat exchanger 40.

Figure 6:
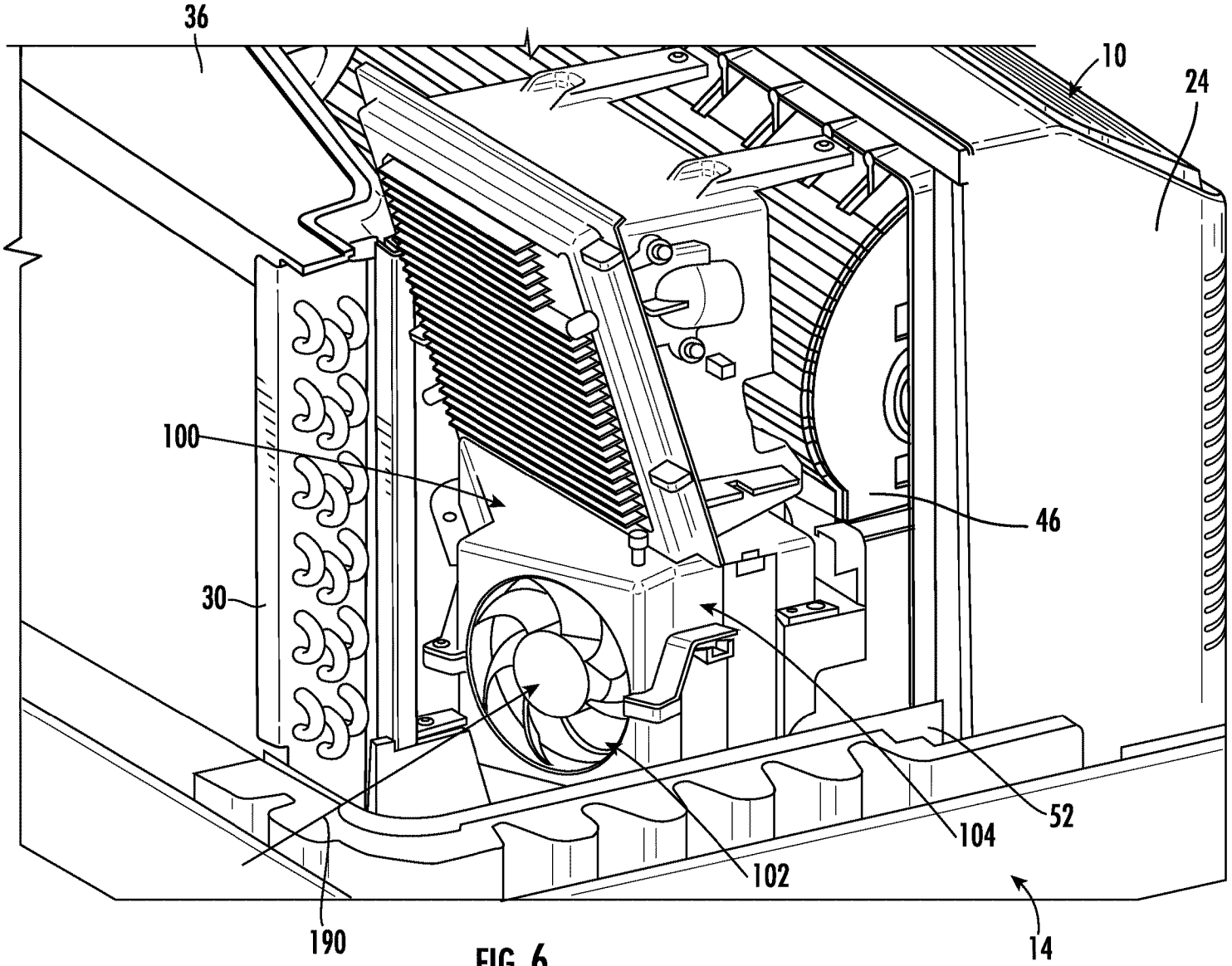
FIG. 6 provides a rear perspective view of the exemplary air conditioner unit and bulkhead of FIG. 4 including a fan assembly for providing make-up air in accordance with exemplary embodiments of the present disclosure.

Referring now to FIG. 6, a fan assembly 100 will be described according to an exemplary embodiment of the present subject matter. According to the illustrated embodiment, fan assembly 100 is generally configured for urging the flow of make-up air through vent aperture 80 and into a conditioned room without the assistance of an auxiliary sealed system. However, it should be appreciated that fan assembly 100 could be used in conjunction with a make-up air module including an auxiliary sealed system for conditioning the flow of make-up air. As illustrated, fan assembly 100 includes an auxiliary fan 102 for urging a flow of make-up air through a fan duct 104 and into indoor portion 12 through vent aperture 80.

According to the illustrated embodiment, auxiliary fan 102 is an axial fan positioned at an inlet of fan duct 104 (e.g., upstream from vent aperture 80). However, it should be appreciated that any other suitable number, type, and configuration of fan or blower could be used to urge a flow of makeup air according to alternative embodiments. In addition, auxiliary fan 102 may be positioned in any other suitable location within air conditioner unit 10 and auxiliary fan 102 may be positioned at any other suitable location within or in fluid communication with fan duct 104. The embodiments described herein are only exemplary and are not intended to limit the scope present subject matter.

Figure 7:
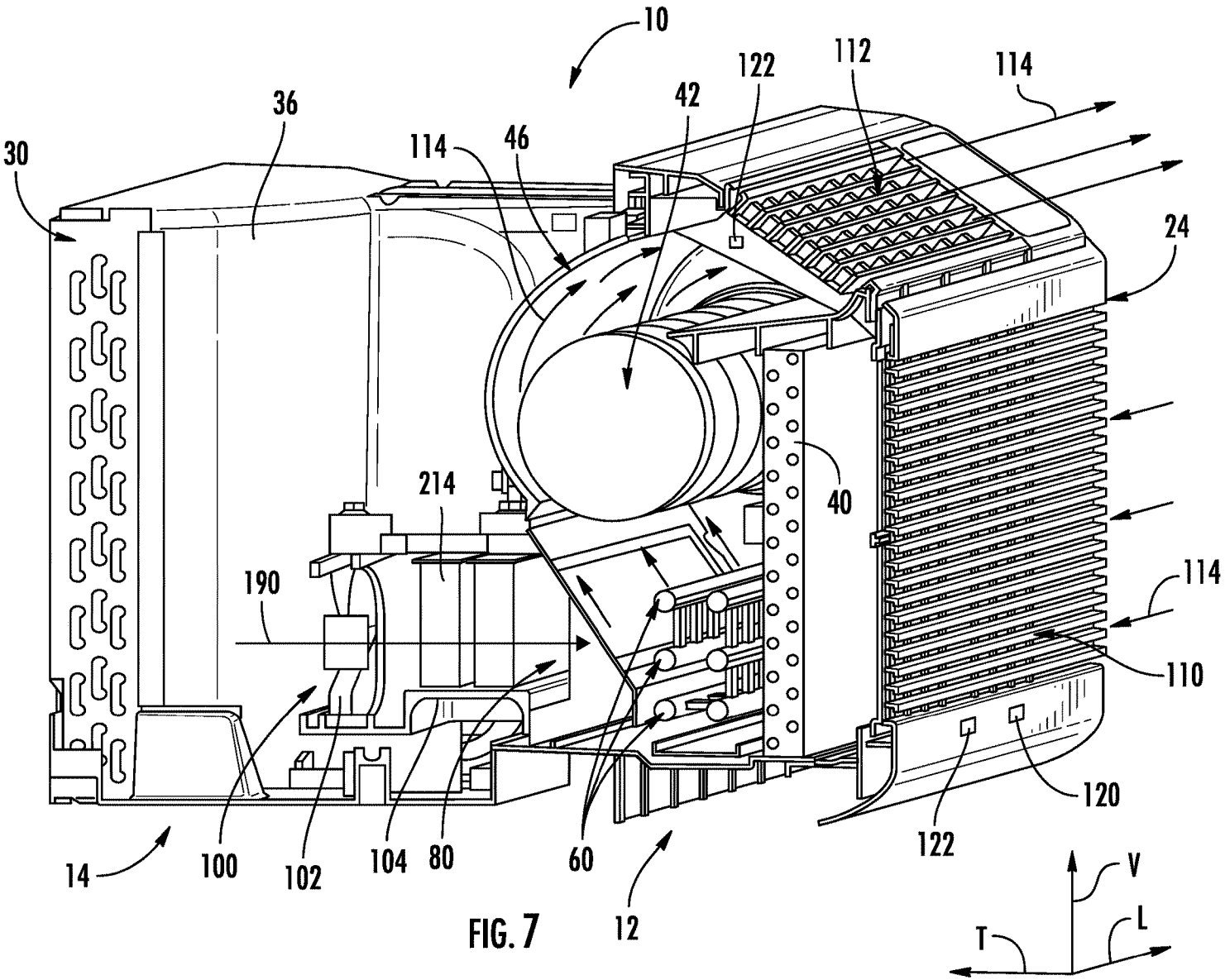
FIG. 7 provides a side cross sectional view of the exemplary air conditioner unit of FIG. 1.
Figure 8:
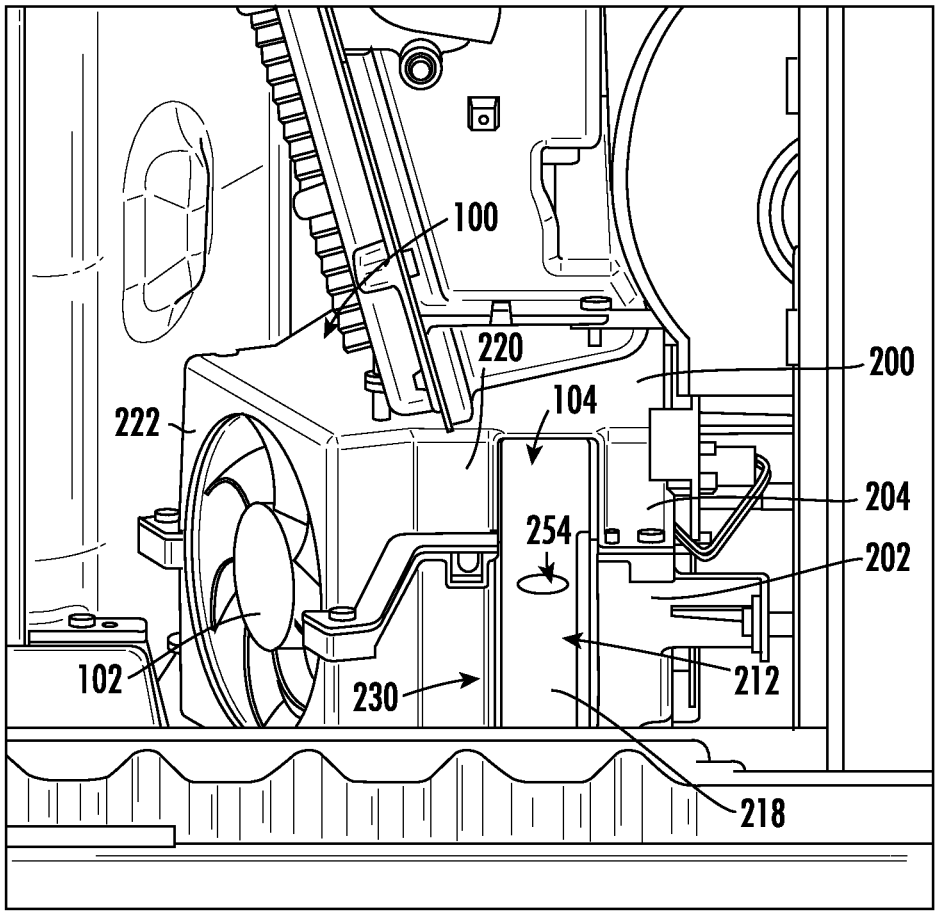
FIG. 8 provides a rear perspective view of the exemplary air conditioner unit and bulkhead of FIG. 4, including a fan assembly for providing make-up air in accordance with exemplary embodiments of the present disclosure.

Referring now to FIG. 7, operation of unit 10 will be described according to an exemplary embodiment. More specifically, the operation of components within indoor portion 12 will be described during a cooling operation or cooling cycle of unit 10. To simplify discussion, the operation of auxiliary fan 102 for providing make-up air through vent aperture 80 will be omitted (e.g., as if vent door 82 were closed). Although a cooling cycle will be described, it should be further appreciated that indoor heat exchanger 40 or heating unit 44 be used to heat indoor air according to alternative embodiments. Moreover, although operation of unit 10 is described below for the exemplary packaged terminal air conditioner unit, it should be further appreciated that aspects the present subject matter may be used in any other suitable air conditioner unit, such as a heat pump or split unit system.

As illustrated, room front 24 of unit 10 generally defines an intake vent 110 and a discharge vent 112 for use in circulating a flow of air (indicated by arrows 114) throughout a room. In this regard, indoor fan 42 is generally configured for drawing in air 114 through intake vent 110 and urging the flow of air through indoor heat exchanger 40 before discharging the air 114 out of discharge vent 112. According to the illustrated embodiment, intake vent 110 is positioned proximate a bottom of unit 10 and discharge vent 112 is positioned proximate a top of unit 10. However, it should be appreciated that according to alternative embodiments, intake vent 110 and discharge vent 112 may have any other suitable size, shape, position, or configuration.

During a cooling cycle, refrigeration loop 48 is generally configured for urging cold refrigerant through indoor heat exchanger 40 in order to lower the temperature of the flow of air 114 before discharging it back into the room. Specifically, during a cooling operation, controller 64 may be provided with a target temperature (e.g., as set by a user for the desired room temperature). In general, components of refrigeration loop 48, outdoor fan 32, indoor fan 42, and other components of unit 10 operate to continuously cool the flow of air.

In order to facilitate operation of refrigeration loop 48 and other components of unit 10, unit 10 may include a variety of sensors for detecting conditions internal and external to the unit 10. These conditions can be fed to controller 64 which may make decisions regarding operation of unit 10 to rectify undesirable conditions or to otherwise condition the flow of air 114 into the room. For example, as best illustrated in FIG. 7, unit 10 may include an indoor temperature sensor 120 which is positioned and configured for measuring the indoor temperature within the room. In addition, unit 10 may include an indoor humidity sensor 122 which is positioned and configured for measuring the indoor humidity within the room. In this manner, unit 10 may be used to regulate the flow of air 114 into the room until the measured indoor temperature reaches the desired target temperature or humidity level. According to exemplary embodiments, unit 10 may further include an outdoor temperature sensor for measuring ambient outdoor temperatures.

As used herein, "temperature sensor" or the equivalent is intended to refer to any suitable type of temperature measuring system or device positioned at any suitable location for measuring the desired temperature. Thus, for example, temperature sensor 120 may each be any suitable type of temperature sensor, such as a thermistor, a thermocouple, a resistance temperature detector, a semiconductor-based integrated circuit temperature sensor, etc. In addition, temperature sensor 120 may be positioned at any suitable location and may output a signal, such as a voltage, to a controller that is proportional to or indicative of the temperature being measured. Although exemplary positioning of temperature sensors is described herein, it should be appreciated that unit 10 may include any other suitable number, type, and position of temperature, or other sensors according to alternative embodiments.

As used herein, the terms "humidity sensor" or the equivalent may be intended to refer to any suitable type of humidity measuring system or device positioned at any suitable location for measuring the desired humidity. Thus, for example, humidity sensor 122 may refer to any suitable type of humidity sensor, such as capacitive digital sensors, resistive sensors, and thermal conductivity humidity sensors. In addition, humidity sensor 122 may be positioned at any suitable location and may output a signal, such as a voltage, to a controller that is proportional to or indicative of the humidity being measured. Although exemplary positioning of humidity sensors is described herein, it should be appreciated that unit 10 may include any other suitable number, type, and position of humidity sensors according to alternative embodiments.

Figure 9:
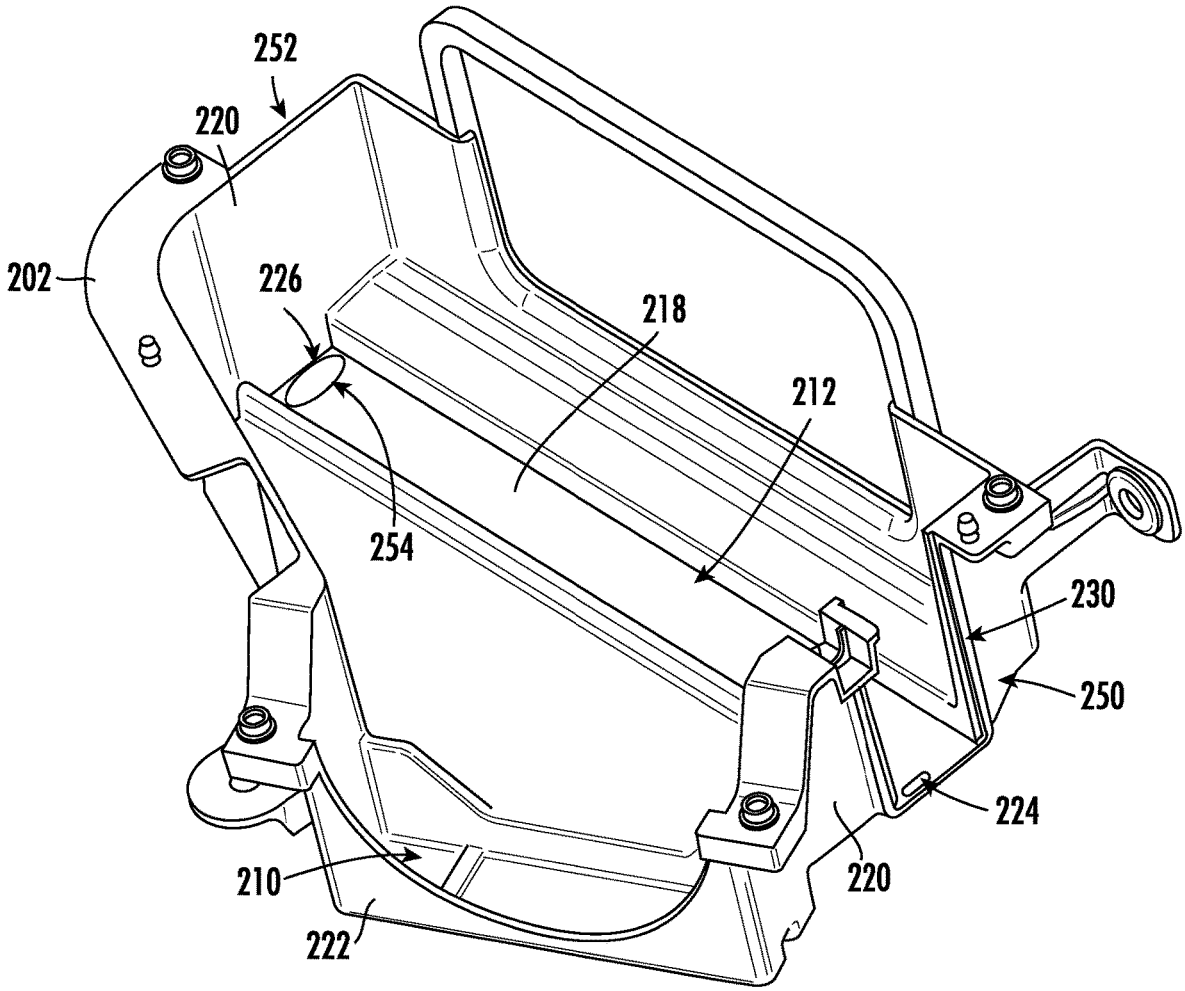
FIG. 9 provides a perspective view of a portion of a fan assembly according to exemplary embodiments of the present disclosure.

Referring now specifically to FIGS. 8 through 11, fan assembly 100 will be described in more detail according to example embodiments of the present disclosure. In this regard, FIGS. 8 and 11 include perspective views of fan assembly 100 within the air conditioner unit 10, while FIGS. 9 and 10 illustrate disassembled views of portions fan assembly 100 without and with additional fan components. Although fan assembly 100 is described herein as being used with air conditioner unit 10, it should be appreciated that fan assembly 100 may be used with other air-conditioning appliances while remaining within the scope of the present disclosure. In addition, the size, position, and configuration of fan assembly 100 may vary without departing from the scope of the present disclosure.

As explained above, fan assembly 100 may generally be configured for using auxiliary fan 102 to urge a flow of makeup air 190 (FIGS. 6 and 7) through fan duct 104 and into indoor portion 12 through vent aperture 80. As shown, fan assembly 100 generally includes a fan housing 200 that includes one or more walls, such as a bottom wall 218 or sidewalls 220. In some embodiments, fan housing 200 includes or is formed from a lower portion 202 and an upper portion 204 that is joined with lower portion 202 of (e.g., using one or more mechanical fasteners) to define makeup air duct 104. Additionally or alternatively, fan housing 200 may define a fan slot 210 or a filter slot 212 (e.g., upstream from vent aperture 80). In general, fan slot 210 is configured for receiving auxiliary fan 102 and filter slot 212 is configured for receiving an air filter 214.

According to the illustrated embodiments, fan slot 210 or filter slot 212 may be defined between or by one or more walls 220 that extend from lower portion 202 and upper portion 204 into makeup air duct 104. For instance, fan slot 210 or filter slot 212 may be defined, at least on part, along one or more portions of bottom wall 218 between the two sidewalls 220 (e.g., below a top wall). In this regard, auxiliary fan 102 may slide into fan slot 210 defined between walls 220 and a front panel 222 of fan housing 200. By contrast, filter slot 212 may be defined between two adjacent and spaced apart walls 220. According to example embodiments, auxiliary fan 102 may be installed in fan housing 200 by positioning auxiliary fan 102 into one half of fan slot 210 (e.g., within lower portion 202) before joining the other half of fan housing 200 (e.g., upper portion 204).

In some embodiments, bottom wall 218 is sloped or slanted such that distinct upper and lower ends 224, 226 (e.g., of an interior duct surface) are defined. In other words, bottom wall 218 may include a sloped or slanted profile within makeup air duct 104. Specifically, an upper end 224 and a lower end 226 that is defined at a lower height than the upper end 224 relative to the vertical direction V may both be defined within the makeup air duct 104. In some embodiments, the bottom wall 218 is sloped (e.g., at a single angle or, alternatively, a plurality of angles) such that the bottom wall 218 descends from the upper end 224 to the lower end 226. The two ends 224, 226 may be defined at opposite sides of the fan housing 200 (e.g., relative to the direction of airflow or makeup air duct 104). In certain embodiments, one side of the fan housing 200 is provided at an exterior-facing side 250 that is proximal to an exterior portion or side of the unit 10 (in the illustrated embodiments, the "right" side as viewed when facing the outdoor portion 14) while an opposite side of the fan housing 200 is provided at an interior-facing side 252 that is distal to the exterior portion or side of the unit 10. Bottom wall 218 may be sloped (e.g., to descend) from the exterior-facing side 250 to the interior-facing side 252. Separate from or in addition to a sloped or slanted profile, bottom wall 218 may define one or more vertical weep holes 254. Generally, each weep hole 254 may extend through bottom wall 218 (e.g., along the vertical direction V). Specifically, each weep hole 254 may extend fully from the makeup air duct 104 and outside of fan housing 200 to the surrounding outdoor portion 14 (e.g., above the base pan 52). In turn, each weep hole 254 may provide a channel through which liquid or moisture (e.g., water from condensed water vapor) may pass, such as might be motivated by gravity. As shown, the bottom wall 218 may be mounted above the base pan 52 on which the bulkhead 46 is supported. Optionally, a vertical gap may be defined between the base pan 52 and the bottom wall 218 of the fan housing 200. Thus, an unobstructed spaced may be provided (e.g., along the vertical direction V) between the weep holes 254 and the base pan 52.

In some embodiments, one or more vertical weep holes 254 are disposed at, or proximal to, the lower end 226. Notably, liquid water within makeup air duct 104 may flow (e.g., perpendicular to the direction of air flow 190) along the bottom wall 218 from the upper end 224 to the lower end 226 and be exhausted out of the makeup air duct 104 through the vertical weep holes 254. The exhausted liquid water may subsequently be permitted to flow from the base pan 52 (e.g., through one or more corresponding drain holes defined through the base pan 52) or be evaporated from the outdoor portion 14 (e.g., as a result of heat generated within the outdoor portion 14, such as at the heat exchanger 30 or compressor 34).

According to example embodiments, fan housing 200 may further define a filter aperture 230 for inserting or removing air filter 214 from filter slot 212. In this regard, a user may slide air filter 214 into filter slot 212 through filter aperture 230. Filter aperture 230 may be defined above the bottom wall 218 (e.g., the entire bottom wall 218 and relative to the vertical direction V). In some embodiments, filter aperture 230 is defined on or at a side of fan housing 200 (e.g., exterior-facing side 250). In this manner, the air filter 214 may be periodically removed for cleaning or may be replaced for desirable air filtration. Notably, embodiments including a sloped bottom wall 218 may provide filter 214 and filter aperture 230 in an orientation for relatively easy access or removal/insertion (e.g., in comparison to existing assemblies).

It should be appreciated that air filter 214 may be any suitable type, size, or rating of filter. For example, air filter 214 may be a pleated filter media, a mesh filter media, a sponge, a HEPA filter, an electrostatic filter, a spun glass filter, or any other suitable type and size of filter medium. In addition, air filter 214 may have any suitable minimum efficiency reporting value (MERV) rating.

When assembled, at least a portion of air filter 214 is disposed above the vertical weep hole 254. For instance, the air filter 214 may be held on or above the bottom wall 218 such that at least a portion of the air filter 214 is disposed at a higher position relative to the vertical direction than vertical weep hole 254. Optionally, air filter 214 may be offset from vertical weep hole 254 (e.g., horizontally or relative to direction of air flow) within makeup air duct 104. For instance, vertical weep hole 254 may be defined at a location within makeup air duct 104 that is upstream from the air filter 214. In some embodiments, air filter 214 rests directly on bottom wall 218. In alternative embodiments, air filter 214 is supported above (e.g., vertically offset from) bottom wall 218. For instance, an elevated ridge 256 may be provided to support air filter 214 within makeup air duct 104. As shown, for instance in FIGS. 10 and 11, elevated ridge 256 may extend from the bottom wall 218 (e.g., upward or generally along the vertical direction V) and through the filter slot 212 (e.g., perpendicular to the direction of airflow within makeup air duct 104). In such embodiments, elevated ridge 256 may hold air filter 214 above bottom wall 218 at a position that is vertically spaced apart from bottom wall 218 and vertical weep hole 254.

According to the illustrated embodiments, air filter 214 is positioned downstream of auxiliary fan 102 (e.g., such that air filter 214 is positioned within makeup air duct 104 between auxiliary fan 102 and vent aperture 80. For instance, filter aperture 230 may be defined at a location along the flow path for make-up air between the auxiliary fan 102 and the vent aperture 80. In turn, the air filter 214 may be positioned downstream from the auxiliary fan 102 or upstream from the vent aperture 80. Nonetheless, it should be appreciated that air filter 214 may be positioned at other suitable locations within the air flow assembly 100 while remaining within the scope of the present disclosure.

As explained herein, aspects of the present disclosure are generally directed to a fan assembly having a clam-shell design of the duct of a PTAC makeup air supply system. The duct may include an integrated fan capturing an auxiliary fan (e.g., a muffin axial fan) and a filter. Additionally or alternatively, aspects of the present disclosure may provide easy access to the filter (e.g., for removal or insertion). Further additionally or alternatively, aspects of the present disclosure may mitigate or prevent moisture from being captured or held along the path for make-up airflow, which might otherwise permit mildew or mold growth.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

a bulkhead defining an indoor portion and an outdoor portion;

a vent aperture defined in the bulkhead; and a fan assembly for urging a flow of make-up air from the outdoor portion through the vent aperture to the indoor portion, the fan assembly comprising:

a fan housing defining a makeup air duct in fluid communication with the vent aperture, the fan housing comprising a bottom wall defining a vertical weep hole to permit water to exhaust from the makeup air duct apart from the vent aperture, and an auxiliary fan positioned within the fan housing, wherein the fan housing defines a filter slot upstream from the vent aperture, wherein the fan housing defines a filter aperture above the bottom wall and along a lateral direction, the lateral direction being perpendicular to the vertical weep hole and a direction of airflow through the makeup air duct, wherein the fan housing extends across the makeup air duct along the lateral direction between an exterior-facing side and an interior-facing side, wherein the filter aperture is defined at the exterior-facing side, and wherein the vertical weep hole is defined proximal to the interior-facing side.

2. The air conditioner unit of claim 1, wherein the fan assembly further comprises an air filter selectively positioned within the filter slot.

3. The air conditioner unit of claim 2, wherein the air filter is disposed above the vertical weep hole.

4. The air conditioner unit of claim 2, wherein the fan housing further comprises an elevated ridge extending from the bottom wall through the filter slot, and wherein the air filter is supported on the elevated ridge.

5. The air conditioner unit of claim 2, wherein the air filter is positioned downstream of the auxiliary fan.

6. The air conditioner unit of claim 1, wherein the bottom wall is sloped such that the bottom wall defines an upper end within the makeup air duct and a lower end within the makeup air duct.

7. The air conditioner unit of claim 6, wherein the vertical weep hole is disposed at the lower end.

8. The air conditioner unit of claim 1, wherein the fan housing comprises:

a lower portion; and an upper portion joined to the lower portion to define the makeup air duct.

9. The air conditioner unit of claim 1, further comprising a base pan supporting the bulkhead, and wherein a vertical gap is defined between the base pan and the bottom wall of the fan housing.

10. A fan assembly for urging a flow of make-up air through an air conditioner unit, the fan assembly comprising:

a fan housing defining a fan slot, a filter slot, and a makeup air duct, the fan housing comprising a bottom wall defining a vertical weep hole to permit water to exhaust from the makeup air duct;

an auxiliary fan positioned within the fan slot of the fan housing; and an air filter positioned within the filter slot above the vertical weep hole, wherein the fan housing defines a filter aperture above the bottom wall and along a lateral direction for inserting or removing the air filter from the filter slot, the lateral direction being perpendicular to the vertical weep hole and a direction of airflow through the makeup air duct, wherein the fan housing extends across the makeup air duct along the lateral direction between an exterior-facing side and an interior-facing side, wherein the filter aperture is defined at the exterior-facing side, and wherein the vertical weep hole is defined proximal to the interior-facing side.

11. The fan assembly of claim 10, wherein the fan housing further comprises an elevated ridge extending from the bottom wall through the filter slot, and wherein the air filter is supported on the elevated ridge.

12. The fan assembly of claim 10, wherein the air filter is positioned downstream of the auxiliary fan.

13. The fan assembly of claim 10, wherein the bottom wall is sloped such that the bottom wall defines an upper end within the makeup air duct and a lower end within the makeup air duct.

14. The fan assembly of claim 13, wherein the vertical weep hole is disposed at the lower end.

15. The fan assembly of claim 10, wherein the fan housing comprises:

a lower portion; and an upper portion joined to the lower portion to define the makeup air duct.

16. An air conditioner unit, comprising:

a bulkhead defining an indoor portion and an outdoor portion;

a vent aperture defined in the bulkhead; and a base pan supporting the bulkhead;

a fan assembly for urging a flow of make-up air from the outdoor portion through the vent aperture to the indoor portion, the fan assembly comprising:

a fan housing defining a makeup air duct in fluid communication with the vent aperture, the fan housing comprising a bottom wall defining a vertical weep hole to permit water to exhaust from the makeup air duct apart from the vent aperture, and an auxiliary fan positioned within the fan housing, wherein the fan housing defines a filter slot upstream from the vent aperture, wherein the fan assembly further comprises an air filter selectively positioned within the filter slot above the vertical weep hole, wherein the fan housing defines a filter aperture above the bottom wall and along a lateral direction for inserting or removing the air filter from the filter slot, the lateral direction being perpendicular to the vertical weep hole and a direction of airflow through the makeup air duct, wherein the fan housing extends across the makeup air duct along the lateral direction between an exterior-facing side and an interior-facing side, wherein the filter aperture is defined at the exterior-facing side, wherein the vertical weep hole is defined proximal to the interior-facing side, and wherein an open vertical gap is defined between the base pan and the bottom wall of the fan housing to permit the draining of condensation within the air conditioner unit.

17. The air conditioner unit of claim 16, wherein the fan housing further comprises an elevated ridge extending from the bottom wall through the filter slot, and wherein the air filter is supported on the elevated ridge.

18. The air conditioner unit of claim 16, wherein the bottom wall is sloped such that the bottom wall defines an upper end within the makeup air duct and a lower end within the makeup air duct.

19. The air conditioner unit of claim 18, wherein the vertical weep hole is disposed at the lower end.

* * * * *